United States Patent [19]

Carr

[11] Patent Number: 4,743,504

[45] Date of Patent: May 10, 1988

[54] POLYESTER YARNS PRODUCED BY HIGH SPEED MELT-SPINNING PROCESSES

[75] Inventor: Paul L. I. Carr, Harrogate, United Kingdom

[73] Assignee: Imperial Chemical Industries Limited, London, England

[21] Appl. No.: 531,975

[22] Filed: Sep. 14, 1983

Related U.S. Application Data

[63] Continuation of Ser. No. 270,297, Jun. 4, 1981, abandoned.

[30] Foreign Application Priority Data

Jun. 14, 1980 [GB] United Kingdom ..... 8020665

[51] Int. Cl.[4] ..... D02G 3/00

[52] U.S. Cl. ..... 428/364; 264/176.1; 264/210.8; 428/373

[58] Field of Search ..... 428/364; 264/176 F, 264/210.8, 210.5

[56] References Cited

U.S. PATENT DOCUMENTS 3,771,307 11/1973 Petrille ..... 264/288.8

3,772,872 11/1973 Piazza et al. ..... 57/243

*Primary Examiner*—Lorraine T. Kendell

*Attorney, Agent, or Firm*—Forrest D. Stine

[57] ABSTRACT

A spun polyester yarn containing ethylene terephthalate as the main or only recurring unit characterized by a percentage crystallinity ($\beta \times 10^2$) of less than 20, a birefringence ($\Delta n$) of at least $50 \times 10^{-3}$, a function A greater than 28 and a function $B \geqq 16$ where $$A = \frac{\Delta n \times 10^3 (IV)}{(dpf)^{\frac{1}{2}}}$$

and $B = (A - 100\ \beta)$ and wherein-IV is the intrinsic viscosity of the spun yarn, $\Delta n$ is the birefringence of the spun yarn and (dpf) is the filament decitex of the spun yarn.

6 Claims, No Drawings

POLYESTER YARNS PRODUCED BY HIGH SPEED MELT-SPINNING PROCESSES

This is a continuation of application Ser. No. 270,297 filed June 4, 1981, now abandoned.

The present invention relates to polyester yarns having a low degree of crystallinity made by high speed melt-spinning processes, such polyester yarns containing ethylene terephthalate as the main or only recurring unit.

In the conventional process of melt-spinning polyester filament yarns in which the filaments are formed by the extrusion of the polymer through a spinneret, are cooled to become solidified and are then wound up, it is well known that the molecular orientation or birefringence of the spun filaments is primarily determined by the wind-up speed. Increasing the wind-up speed increases the birefringence of the filaments, so that at very high wind-up speeds the filaments begin to have useful mechanical properties and may not require to undergo a subsequent drawing step. Also, at high wind-up speeds, the filaments attain their final diameters at a higher polymer temperature because of the increased strain rate imposed on the spinning threadline of filaments.

Under such conditions, molecular chains, nucleated by the high orientation, crystallise, such that at wind-up speeds in the range 4,500 to 6,000 meters/minute low shrinkage, crystalline, yarns are produced. At lower wind-up speeds, eg in the range 3,500 to 4,500 meters/-minute, the molecular orientation is not so high but is nevertheless sufficient to nucleate and increase the rate of cyrstallisation so that partially crystalline filaments are produced. This partial crystallisation is sufficient to influence the structure and dyeing properties of the final yarn even after having undergone a subsequent drawing or draw-texturing step.

It has been found that this intermediate level of crystallinity is highly dependent on the temperature of crystallisation; this temperature being the temperature of the spinning filaments in the spinning chimney at some distance from the spinneret. It has also been found that the temperature and stress conditions of the spinning threadline of filaments, which influence the degree of crystallisation, are themselves dependent on all the spinning process conditions such as extrusion temperature, cooling rate, mass throughput and polymer viscosity.

Therefore, good dye uniformity in the final product may be achieved more readily by spinning an amorphous polyester yarn feedstock, normally by restricting the wind-up speed to approximately 3500 m/min. A partially crystalline polyester yarn feedstock leads to dyeing problems when drawn or draw-textured and made into fabrics and it is extremely difficult to improve uniformity of dyeability of those feedstock yarns produced in the 3,500 to 4,500 meters/minute wind-up speed range by tighter process control.

The present invention provides a substantially non-crystalline polyester yarn feedstock which, when subsequently drawn or draw-textured and made into fabrics, exhibits uniform dyeing characteristics at high wind-up speeds which can be as high as 4,500 meters/minute or more.

The invention also provides a melt-spinning process which enables substantially non-crystalline yarns to be spun from a polyester polymer at much higher wind-up speeds than used previously.

Such a process exploits the productivity advantages of higher spinning speeds while at the same time maintaining the uniform dyeing characteristics of feedstock yarns spun at lower wind-up speeds. In addition the novel combination of higher birefringence and low crystallinity leads to a feed yarn with the potential for increased crimp development during subsequent draw texturing processes.

A spun polyester yarn of the invention has a percentage crystallinity ($\beta \times 10^2$) of less than 20, a birefringence ($\Delta n$) of at least $50 \times 10^{-3}$, a function A greater than 28 and a function $B \geqq 16$ where $$A = \frac{\Delta n \times 10^3 (IV)}{(dpf)^{\frac{1}{2}}}$$

and $B = (A - 100\beta)$ and wherein IV is the intrinsic viscosity of the spun yarn, $\Delta n$ is the birefringence of the spun yarn and (dpf) is the filament decitex of the spun yarn. Preferred yarns have a birefringence of between $50 \times 10^{-3}$ and $100 \times 10^{-3}$ and more preferably between $60 \times 10^{-3}$ and $100 \times 10^{-3}$.

We also prefer that the yarns of the invention have an intrinsic viscosity of between 0.55 and 0.70.

The yarns of the invention are found to have a high amorphous orientation (fam); greater than $15 \times 10^{-2}$ and usually greater than $20 \times 10^{-2}$ being obtained. In contrast, with a conventional melt-spinning process, values of amorphous orientation as high as this are not normally obtained.

The crystallinity of the yarn is obtained from yarn density measurements using the formula:

$$\beta = \frac{\rho c}{\rho} \cdot \frac{\rho - \rho a}{\rho c - \rho a}$$

where $\rho c$ = crystalline density = 1.455 gm/cc (maximum theoretical value)

$\rho a$ = amorphous density = 1.335 gm/cc $\rho$ = fibre density gm/cc $\beta$ = fractional crystallinity by weight The fibre density is measured by immersing small samples of the fibre in a calcium nitrate solution density column. The samples were first placed in a low strength solution under vacuum for 30 minutes to remove trapped air from the fibre prior to immersion. The samples were left in the column for 24 hours before the density was measured.

Birefringence is measured using a polarizing microscope and a Berek compensator as described for example by R C Faust in "Physical methods of Investigating Textiles", edited by R Meredith and J W S Hearle and published by Textile Publishers Inc.

The amorphous orientation (fam) is calculated using the equation:

$$fam = \frac{\Delta n - 0.22\beta}{0.275(1 - \beta)}$$

The derivation of amorphous orientation is discussed in "Structural Polymer Properties" by R J Samuels, Wiley 1974. The intrinsic viscosity of the polymer is a measure of the polymer molecular weight and is determined by comparing the viscosity of a 1% solution of a sample of the spin fibre in orthochlorophenol with the viscosity of the pure solvent as measured at 25° C. in a capillary viscometer.

IV is calculated using the formula:

$$IV = \frac{\eta s}{c}$$

where $$\eta s = \text{specific viscosity} = \frac{\text{flow time of solution}}{\text{flow time of solvent}} - 1$$

and C is the concentration of the solution in gm/100 ml. Decitex per filament (dpf) is the weight in grams of a 10,000 meter length of filament and is measured using a one meter wrap wheel to obtain the total yarn decitex and dividing by the number of filaments in the yarn.

Boiling water shrinkage, as will be referred to hereafter, is measured by suspending a weight sufficient to give a load of 0.1 gm/decitex on a length of yarn $L_1$. This load is removed and replaced by a smaller weight to give a load of 0.001 gm/decitex. The yarn is then immersed in boiling water for 15 minutes. The sample is removed, allowed to dry and the load is increased to 0.1 gm/decitex and the new length $L_2$ measured.

The boiling water shrinkage $$= \frac{L_1 - L_2}{L_1} \times 100$$

We have also referred to the yarns of the invention exhibiting uniform dyeing characteristics at high wind-up speeds. Whether yarns have such characteristics may be determined as follows:

Sample yarns were drawn at 300 m/min on a conventional draw twist machine using a heated feed roll temperature of 85° C. and a hot plate temperature of 180° C. The yarn was pretensioned between a nip roll and a feed roll using a predraw ratio of 1:1.008. The main draw ratio was chosen to give an extension to break of 25%, which could be selected once the birefringence of the spun yarn was known. Drawn yarns were knitted on a Krenzler stocking machine and dyed in a Turbomat dyeing machine with 1% Navy D2G (Colour Index Disperse Blue 122) at 125° C. for one hour without carrier.

The dye uptake was then measured on the samples using an Appearance Meter. This measures the light reflected from the dyed yarn, using photocell detectors, and one Appearance Meter Unit (AMU) equals a 1% change in reflectance of the samples under test. It is generally found that when different yarns are knitted in blocks, one Appearance Meter Unit causes a just visible junction.

Other tests can be used which allow for shade as well as dye uptake, but this test is adequate for comparing samples which are nominally of the same shade.

According to another aspect of the invention we provide a process for spinning yarns from a synthetic linear polyester containing ethylene terephthalate as the main or only recurring unit at a wind-up speed of between 3,500 and 5,000 meters/minute under those controlled thermal conditions which produce yarns having a percentage crystallinity ($\beta \times 10^2$) of less than 20, a birefringence ($\Delta n$) of at least $50 \times 10^{-3}$, a function A greater than 28, a function $B \geqq 16$, where $$A = \frac{\Delta n \times 10^3 (IV)}{(dpf)^{\frac{1}{3}}}$$

$$B = (A - 100\beta)$$

and wherein IV is the intrinsic viscosity of the spun yarns, $\Delta n$ is the birefringence of the spun yarns and (dpf) is the filament decitex of the spun yarn. We prefer that the process produces yarns having a birefringence of between $50 \times 10^{-3}$ and $100 \times 10^{-3}$ and more preferably between $60 \times 10^{-3}$ and $100 \times 10^{-3}$. In preference the spun yarns will also have an intrinsic viscosity of between 0.55 and 0.70.

As mentioned above, by a suitable choice of process parameters it is possible to alter the stress-temperature history of the polymer in the spinning threadline so that the degree of crystallisation occurring during spinning at a given wind-up speed is increased or decreased. A reduction in spinning stress leads to an increase in the wind-up speed at which a substantially non-crystalline yarn can be spun. However, in practice, the choice of spinning parameters is considerably restricted by other considerations, and it is difficult to prevent crystallisation at wind-up speeds above 3,500 meters/minute. However we have now found several methods which raise the maximum wind-up speed at which yarns having a percentage crystallinity less than 20 can be spun; the most effective method raising the speed to 4,500 meters/minute or more.

In one embodiment of the process of the invention we pass the filament yarn, immediately as it leaves the spinneret, through a heated zone. In the heated zone, there will be a significant reduction in the rate of cooling in the initial region of the spinning threadline compared with the rate of cooling achieved by natural or forced air convection in the spinning chimney in a conventional process.

This reduced cooling rate reduces the threadline tension sufficiently to ensure that molecular orientation does not occur until lower threadline temperatures are reached. In consequence the yarn is less likely to crystallise.

The heated zone may take the form of a heated shroud or alternatively heating may be achieved by blowing hot air across the threadline from a quench or other suitable diffusing device.

The effectiveness of the heated zone in reducing crystallisation is dependent on both its length and its temperature. In practice the heated zone will typically have a length in the range 5 cm to 100 cm and have a temperature in the range 200° C. to 500° C.

Of course, processes employing heated shrouds immediately below the spinneret are known. Usually, however, they are employed to reduce molecular orientation in high intrinsic viscosity spinning processes by reducing the threadline stress in the initial stretching region below the spinneret. In British Patent Specification No. 1006136, there is described such a process in which shroud lengths of 30 cm or more are employed with wind-up speeds below 300 meters/minute to produce a spun yarn with a birefringence less than $3 \times 10^{-3}$. Low spun yarn orientation is required to yield the very high drawn yarn tenacities which are required in industrial yarn.

Similarly in Japanese Patent No. 52 121529 is described a process in which a heated zone is utilised immediately below the spinneret in conjunction with a wind-up speed of the order of 700 meters/minute to produce a spun yarn feedstock which can be drawn to high tenacities.

In British Patent Application No. 2002681 A is described another process which utilises a 60 cm quiescent zone immediately below the spinneret to reduce the spun yarn birefringence of yarn spun from polyester of higher than normal intrinsic viscosity (0.70) containing a branching agent such as pentaethrytol. The wind-up speeds may be up to 4,000 meters/minute but the basic object of the process is to reduce birefringence.

In another embodiment of the invention the process is operated at a polymer extrusion temperature in excess of 330° C., and more preferably in excess of 340° C.

A process for utilising such high extrusion temperatures is described in British Patent Specification No. 1 235 338 but the described process is specifically limited to the spinning of high intrinsic viscosity polymer at low wind-up speeds to achieve low orientation in the spun yarns. The operation of the process at high wind-up speeds to produce a novel balance of properties is not contemplated.

In yet another embodiment of the process of the invention, the spinning threadline, after passing through a quench zone, as in the conventional processes, is passed through a heated zone which reheats the threadline to a temperature between the glass transition temperature (Tg) of the polymer and the crystallisation temperature (Tc) of the polymer corresponding to the final birefringence of the yarn. The heated zone causes part of the final molecular orientation of the spun yarn to occur at a lower temperature in the threadline by inducing a secondary draw down zone lower down the spinning chimney. The heated zone can take a variety of forms. It can be a hot air tube with counter-or co-current air flow, a heated tube or a steam chamber. Since the molecular orientation of the spun yarn is wind-up speed dependent, the preferred temperature of the heated zone is also wind-up speed dependent. In general, the secondary heating zone should be such that the yarn temperature is raised to between 80° C. and 150° C. However, as the birefringence rises, the temperature of crystallisation (Tc) falls until, at a certain birefringence, it is coincident with Tg and at this point there is no temperature at which the yarn will draw down at high wind-up speeds without crystallisation. This, therefore, determines the upper limit of wind-up speed available when using this process to produce yarns having the specified properties.

The invention will now be described with reference to the following Examples.

EXAMPLE 1

Polyethylene terephthalate of intrinsic viscosity 0.67 was spun in a conventional manner through a 20 hole spinneret with 0.009 inch diameter orifices. The mass throughput was varied with the wind-up speed to give approximately a 100 decitex 20 filament yarn and the extrusion temperature was maintained at 295° C.

A spun yarn having an IV of 0.63 was obtained.

A conventional quench zone was provided in which cooling air (at room temperature) was applied to the yarn with a cross flow at a linear velocity of 75 meters/-minute.

Yarn birefringence, boiling water shrinkage and crystallinity of the yarns produced at a range of wind-up speeds between 2,000 and 4,000 meters/minute are given in Table 1.

Birefringence was measured in the manner described hereinbefore.

Boiling water shrinkage was measured as described.

Crystallinity was calculated from density measurements in the manner described previously.

Tests, as described previously, were also carried out with the yarns produced to ascertain whether they had uniform dyeing characteristics after being drawn: The dye uptake of the drawn yarn was measured as described previously and a graph plotted of drawn yarn dye uptake against wind-up speed. It was found that at a particular wind-up speed the dye uptake passes through a minimum value where the sensitivity to small changes in wind up speed is low. In table 1 and subsequent tables the slope (ΔDU) of this graph is indicated as a rate of change of dye uptake per 1000 meters/min change in wind up speed at selected wind up speeds.

Experience also shows that at wind up speeds close to this minimum the sensitivity of dye uptake to other process changes such as quench and extrusion temperature are also much reduced. It will therefore be appreciated that it is desirable to operate melt spinning processes at such wind up speeds.

The results in Table 1 show that with the conventional process, crystallinity of the yarns produced rises with increasing spun yarn birefringence as illustrated in the graph shown in FIG. 1.

Also the table indicates those spun yarns which inherently have level dyeing characteristics, and which when drawn have a change in dye uptake (ΔDU) per 1000 meter/min change in wind-up speed in the region of zero. In this Example such yarns can be produced at a wind-up speed in the region of 3000 m/min.

However with the conditions prevailing in this Example function B for the yarns produced is less than 16 and function A is less than 28 and so the yarns produced are outside the scope of the invention.

EXAMPLE 2

Polyethylene terephthalate of IV 0.65 was spun through a 20 hole spinneret with 0.009 inch diameter orifices. The extrusion temperature was 290° C. The mass throughput was kept approximately constant at 2.75 gms/min per hole and therefore the yarn decitex varied with wind-up speed. Also in contrast to Example 1, cross flow cooling with air was not used. The spun yarn had an IV of 0.621. The relevant properties of the yarns produced were measured and/or calculated and recorded in Table 2 and in graphical form (see curve shown in FIG. 1).

The results show that even at high mass throughputs and minimum cooling rates, the balance of crystallinity and birefringence is not sufficiently altered to raise the value of function B very much. However, the wind-up speed corresponding to the spun yarn which inherently has the most uniform dyeing characteristics is raised and now lies between 3,000 meters/minute and 3,500 meters/minute.

Example 1 and 2 shows that the conventional spinning process employing either a cross draught of air (Example 1) or no air draught (Example 2) to cool the spinning threadline after extrusion, does not produce the yarns of the invention. Furthermore, those yarns which inherently have level dyeing characteristics can only be produced at wind-up speeds less than 3,500 meters/minute.

EXAMPLE 3

Example 1 was repeated except that the spun yarn IV was reduced to 0.514, the extrusion temperature being 287° C. Again the results were tabulated (Table 3) and recorded in graphical form (see FIG. 1).

The results show that crystallisation is significantly reduced at wind-up speeds of 4,000 meters/minute and above. Furthermore those yarns produced at a wind-up speed slightly greater than 4,000 meters/minute will inherently have uniform dyeing characteristics.

However spun yarns having such a low intrinsic viscosity are not desirable because they will have a reduced breaking load, reduced modulus and inferior crimp retention.

In any event the yarns produced are outside the scope of the present invention.

EXAMPLE 4

Example 1 was repeated using the same mass throughput but with an extrusion temperature of 290° C. The spun yarn IV was 0.653.

An air quench was not used. Instead the spinning threadline, immediately after extrusion, was passed through an electrically heated, 60 cm long, tubular jacket sealed to the face of the extrusion pack. The jacket provided an air temperature of 295° C. measured half way down the jacket.

The results were tabulated (Table 4) and graphed (FIG. 1).

From the results it is apparent that yarns which inherently have uniform dyeing characteristics can be produced at a wind-up speed in the range 4,000 to 4,500 meters/minute, such yarns having a percentage crystallinity less than 20, a function A greater than 28 and a function B greater than 16.

EXAMPLE 5

This Example was similar to Example 4 except that the jacket had a length of 7.5 cm and produced an air temperature of 450° C. The extrusion temperature was 307° C.

The mass throughput was kept constant at approximately 2.75 gms/min per spinneret hole as in Example 2. The IV of the spun yarn was 0.646.

The results obtained appear in Table 5, and, in graphical form in FIG. 1.

From these it is apparent that a short shroud at a much higher temperature also is effective in reducing the crystallisation of yarn spun at 4,000 to 4,250 m/min, and therefore in producing a yarn with level dyeing characteristics at wind up speeds above 4,000 m/min. However such high temperatures are not preferred as temperature control both of the shroud itself, and of the spinning pack is more difficult.

EXAMPLE 6

Example 5 was repeated in entirety except that the air temperature in the jacket was 295° C. The spun yarn IV was 0.65. The results appear in Table 6. They serve to show that certain jacket conditions will not produce yarns in accordance with the invention. Furthermore with the conditions pertaining in this Example yarns which inherently have uniform dyeing characteristics can only be produced at much lower speeds ie 3,500 meters/minute compared with the speeds at which yarns having inherent level dyeing characteristics can be produced in accordance with Example 5.

It will therefore be apparent that the jacket conditions ie length and temperature, require to be adjusted in order that yarns which inherently have level dyeing characteristics may be produced at higher than normal wind-up speeds.

EXAMPLE 7

Example 1 was repeated except that a spinning pack as described in British Pat. No. 1 235 338 was used. This enabled particularly high extrusion temperatures to be obtained without excessive polymer degradation. The mass throughput was kept constant at approximately 2.75 gms/min per spinneret hole as in Example 2. In this Example, the extrusion temperature was 340° C. and the spun yarn IV was 0.61. The results obtained are shown in Table 7. The example was also repeated at an extrusion temperature of 330° C. but the yarns obtained did not have a balance of properties such that function $B \geqq 16$, and, when drawn, did not have level dyeing characteristics at the required high wind-up speeds. This for particularly high extrusion temperatures, high wind-up speeds and normal IV polymer, yarns with the claimed balance of properties are obtained, such yarns having level dyeing characteristics at higher wind-up speeds than would be expected.

EXAMPLE 8

Example 1 was repeated except that the spun yarn was passed through a heated, 1 meter long, tube located with its inlet 1.5 meters below the spinneret. The yarn was converged at the top of the tube. The tube had a diameter of 4 cm and was heated to give an air temperature of 130° C. at a point half way down the tube. The spun yarn IV was 0.625.

The results are set out in Table 8. They show that yarns which inherently have level dyeing characteristics can be produced at a speed in the range 4,000 to 4,500 meters/minute, such yarns having the claimed balance of properties.

It will be realised that the air temperature within tube and the location of the tube in relation to the spinneret will have an effect on the precise balance of properties of the yarns which are produced and the optimum wind-up speed of such yarns required to produce level dyeing characteristics. Furthermore the stability of the process will be affected by the heat transfer from the air within the tube.

EXAMPLE 9

Example 8 was repeated using an atmosphere of steam at atmospheric pressure within the tube. The extrusion temperature was 295° C. and the spun yarn IV was 0.645. The mass throughput was kept constant at approximately 2.75 gms/min per spinneret hole as in Example 2. The results are tabulated in Table 9. As would be expected, because the steam is at atmospheric pressure, the optimum wind-up speed at which level dyeing characteristics can be achieved is slightly lower than in Example 8. Nevertheless, yarns having level dyeing characteristics can still be produced at wind-up speeds in the region of 4,000 meters/minute.

The advantages claimed for the yarns of the invention in terms of uniformity of dyeing characteristics at high wind-up speeds is illustrated in the tables by the slope of the dye uptake/wind-up speed relationship which is quoted as the change in dye uptake ($\Delta DU$) per 1000 meter/min change in wind-up speed.

For the yarn and process of the invention, the minimum value of the dye uptake sensitivity occurs at wind-up speeds which are clearly higher than those in conventional melt spinning processes. The function $B=A-100\beta$, which constitutes one boundary of the invention in terms of claimed yarn properties when $B \geqq 16$ also has a maximum value at a wind-up speed which approximately corresponds to the wind-up speed at which minimum dye sensitivity occurs. Therefore using this function, and measured yarn properties the preferred operating wind-up speeds can be determined without lengthy experimentation involving dyeing tests.

TABLE 1

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n \text{ IV } 10^3}{(dpf)^{\frac{1}{3}}}$ | $B = A - 100\beta$ | $\frac{\Delta DU}{WUS}$ AMU/1000 m/m |
|---|---|---|---|---|---|---|---|
| 2000 | 16.6 | 54.8 | 7.58 | 0.13 | 6.01 | −1.57 | −44 |
| 2500 | 23.1 | 60.2 | 8.21 | 2.00 | 8.46 | +0.25 | −18.6 |
| 3000 | 38.1 | 50.9 | 9.46 | 8.07 | 14.30 | +4.84 | +2.4 |
| 3500 | 43.4 | 40.4 | 10.98 | 6.15 | 16.03 | +5.05 | +28.0 |
| 4000 | 66.0 | 15.7 | 16.84 | 12.66 | 24.33 | +7.49 | +45.0 |

TABLE 2

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n \text{ IV } 10^3}{(dpf)^{\frac{1}{3}}}$ | $B = A - 100\beta$ | $\frac{\Delta DU}{WUS}$ AMU/1000 m/m |
|---|---|---|---|---|---|---|---|
| 2500 | 24.39 | 60.8 | 7.23 | 3.33 | 6.79 | −0.44 | −16.2 |
| 3000 | 32.17 | 58.8 | 7.92 | 5.81 | 9.49 | +1.57 | −7.4 |
| 3500 | 52.06 | 58.0 | 9.60 | 12.42 | 16.18 | +6.58 | +2.4 |
| 4000 | 66.48 | 51.8 | 11.98 | 16.59 | 21.73 | +9.75 | +16.4 |
| 4500 | 82.34 | 18.5 | 17.44 | 19.36 | 27.99 | +10.55 | +40 |
| 5000 | 98.05 | 3.7 | 32.96 | 13.86 | 34.52 | +1.56 | +43 |

TABLE 3

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n \text{ IV } 10^3}{(dpf)^{\frac{1}{3}}}$ | $B = A - 100\beta$ | $\frac{\Delta DU}{WUS}$ AMU/1000 m/m |
|---|---|---|---|---|---|---|---|
| 3000 | 38.58 | 62.9 | 7.85 | 8.41 | 11.5 | +3.65 | −11.9 |
| 3500 | 43.27 | 62.5 | 8.84 | 9.51 | 12.93 | +4.09 | −7.8 |
| 4000 | 66.56 | 61.7 | 10.62 | 17.57 | 19.89 | +9.27 | −0.8 |
| 4500 | 76.66 | 50.4 | 13.56 | 19.69 | 22.9 | +9.34 | +8.6 |
| 5000 | 89.69 | 7.25 | 24.56 | 17.19 | 26.85 | +2.29 | +20.8 |

TABLE 4

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n\ 10^3 \text{ (IV)}}{(dpf)^{\frac{1}{3}}}$ | $B = A - 100\beta$ | ΔDU AMU/1000 m/min |
|---|---|---|---|---|---|---|---|
| 2500 | 25.4 | 58.5 | 6.32 | 4.46 | 9.76 | +3.44 | |
| 3000 | 36.5 | 63.0 | 8.57 | 7.02 | 13.91 | +5.34 | |
| 3500 | 52.1 | 63.5 | 10.35 | 11.89 | 19.84 | +9.49 | −11.1 |
| 4000 | 78.0 | 55.9 | 11.69 | 21.22 | 30.21 | +18.52 | −1.6 |
| 4500 | 83.7 | 48.4 | 14.89 | 19.63 | 31.96 | +17.07 | +7.2 |
| 5000 | 98.5 | 8.0 | 24.38 | 19.06 | 37.59 | +13.21 | +18 |
| 5500 | 110.5 | 4.1 | 37.15 | 16.65 | 42.15 | | +24 |

TABLE 5

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n\ 10^3 \text{ (IV)}}{(dpf)^{\frac{1}{3}}}$ | $B = A - 100\beta$ | ΔDU AMU/1000 m/min |
|---|---|---|---|---|---|---|---|
| 2500 | 26.5 | 59.4 | 8.48 | 3.12 | 10.11 | +1.63 | −17.6 |
| 3000 | 40.8 | 60.0 | 9.37 | 8.09 | 16.2 | +6.83 | −16.4 |
| 3500 | 55.7 | 57.6 | 10.89 | 12.95 | 23.1 | +12.21 | −13.0 |
| 3750 | 64.0 | 55.1 | 12.05 | 15.5 | 27.0 | +14.95 | −6.9 |
| 4000 | 72.4 | 50.2 | 13.83 | 17.71 | 31.1 | +17.27 | +0.9 |
| 4250 | 81.0 | 36.8 | 14.54 | 20.86 | 35.07 | +20.53 | +16.4 |
| 4500 | 87.7 | 13.8 | 20.97 | 19.12 | 38.36 | +17.39 | +37.0 |
| 5000 | 95.9 | 4.6 | 33.9 | 11.73 | 42.69 | +8.79 | +45.0 |

TABLE 6

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n\ 10^3 \text{ (IV)}}{(dpf)^{\frac{1}{3}}}$ | $B = A - 100\beta$ | ΔDU AMU/1000 m/min |
|---|---|---|---|---|---|---|---|
| 2500 | 28.5 | 60.6 | 7.5 | 4.71 | 10.92 | +3.42 | −20.6 |
| 3000 | 39.14 | 58.3 | 8.7 | 7.99 | 15.63 | +6.93 | −13.2 |

TABLE 6-continued

| WIND-UP SPEED m/min | BIRE-FRINGENCE $\Delta n \times 10^3$ | BOILING WATER SHRINKAGE % | CRYSTAL-LINITY $\beta \times 10^2$ % | AMORPHOUS ORIENTATION fam $\times 10^2$ | $A = \frac{\Delta n\ 10^3\ (IV)}{(dpf)^{\frac{1}{3}}}$ | B = A − 100 $\beta$ | ΔDU AMU/1000 m/min |
|---|---|---|---|---|---|---|---|
| 3500 | 55.2 | 50.5 | 11.4 | 12.36 | 22.97 | +11.57 | 0 |
| 4000 | 70.8 | 15.9 | 18.43 | 13.48 | 30.72 | +12.29 | +13.4 |
| 4500 | 84.98 | 4.0 | 33.3 | 6.4 | 38.0 | +4.7 | +24 |
| 5000 | 94.6 | 3.6 | 36.5 | 8.19 | 42.26 | +5.76 | +30.2 |

TABLE 7

| WIND-UP SPEED m/min | BIRE-FRINGENCE $\Delta n \times 10^3$ | BOILING WATER SHRINKAGE | CRYSTAL-LINITY $\beta \times 10^2$ | AMORPHOUS ORIENTATION fam $\times 10^2$ | $A = \frac{\Delta n\ 10^3\ IV}{(dpf)^{\frac{1}{3}}}$ | B = A − 100 $\beta$ | ΔDU AMU/1000 m/min |
|---|---|---|---|---|---|---|---|
| 2500 | 25.67 | 50.2 | 7.76 | 3.88 | 9.26 | +1.5 | −19 |
| 3000 | 34.18 | 58.6 | 8.30 | 6.3 | 12.81 | +4.51 | −18.2 |
| 3500 | 47.67 | 59.5 | 9.64 | 10.64 | 18.6 | +8.96 | −16.4 |
| 3750 | 57.69 | 59.4 | 10.44 | 13.77 | 22.94 | +12.5 | −13.8 |
| 4000 | 66.63 | 58.6 | 10.80 | 17.48 | 26.93 | +16.13 | −6.6 |
| 4250 | 73.53 | 53.3 | 12.49 | 19.14 | 30.72 | +18.23 | +1.2 |
| 4500 | 83.18 | 36.8 | 14.27 | 21.96 | 35.02 | +20.75 | +12.1 |
| 5000 | 94.17 | 5.8 | 26.47 | 17.77 | 39.64 | +13.17 | +52.0 |

TABLE 8

| WIND-UP SPEED m/min | BIRE-FRINGENCE $\Delta n \times 10^3$ | BOILING WATER SHRINKAGE | CRYSTAL-LINITY $\beta \times 10^2$ | AMORPHOUS ORIENTATION fam $\times 10^2$ | $A = \frac{\Delta n\ 10^3\ IV}{(dpf)^{\frac{1}{3}}}$ | B = A − 100 $\beta$ | ΔDU AMU/1000 m/min |
|---|---|---|---|---|---|---|---|
| 3000 | 60 | 64.5 | 11.0 | 14.62 | 22.07 | +11.0 | — |
| 3500 | 64 | 63.5 | 12.5 | 15.16 | 23.5 | +11.0 | −23 |
| 4000 | 90 | 65.7 | 13.75 | 26.35 | 32.42 | +18.67 | −1.2 |
| 4500 | 92 | 57.7 | 15.4 | 24.11 | 34.26 | +18.86 | +22.6 |
| 5000 | 94 | 8.5 | 27.5 | 16.8 | 34.41 | +6.91 | +31.4 |
| 5500 | 108 | 4.1 | 37.1 | 15.25 | 39.56 | +2.46 | — |

TABLE 9

| WIND-UP SPEED m/min | BIRE-FRINGENCE $\Delta n \times 10^3$ | BOILING WATER SHRINKAGE | CRYSTAL-LINITY $\beta \times 10^2$ | AMORPHOUS ORIENTATION fam $\times 10^2$ | $A = \frac{\Delta n\ 10^3\ IV}{(dpf)^{\frac{1}{3}}}$ | B = A − 100 $\beta$ | ΔDU AMU/1000 m/min |
|---|---|---|---|---|---|---|---|
| 2500 | 54.13 | 57.6 | 10.89 | 12.31 | 20.6 | +9.71 | |
| 3000 | 70.31 | 58.0 | 12.14 | 18.04 | 27.82 | +15.68 | |
| 3500 | 87.02 | 58.2 | 14.27 | 23.59 | 35.96 | +21.69 | −16.8 |
| 3750 | 88.20 | 58.3 | 14.89 | 23.68 | 37.11 | +22.22 | −10.0 |
| 4000 | 89.9 | 57.9 | 15.16 | 24.24 | 38.38 | +23.22 | 0 |
| 4250 | 90.55 | 52.2 | 14.98 | 24.63 | 39.17 | +24.19 | +10.2 |
| 4500 | 83.9 | 6.9 | 30.46 | 8.83 | 36.6 | +6.14 | +41.2 |
| 5000 | 95.29 | 4.5 | 38.01 | 6.84 | 43.0 | +4.99 | |

I claim:

1. A spun polyester yarn containing ethylene terephthalate as the main or only recurring unit having a percentage crystallinity ($\beta \times 10^2$) of less than 20, a birefringence ($\Delta n$) of at least $50 \times 10^{-3}$, a function A greater than 28 and a function $B \geqq 16$ where $$A = \frac{\Delta n \times 10^3 (IV)}{(dpf)^{\frac{1}{3}}}$$

and $B = (A - 100\beta)$ and wherein IV is the intrinsic viscosity of the spun yarn, $\Delta n$ is the birefringence of the spun yarn and (dpf) is the filament decitex of the spun yarn.

2. A spun polyester yarn as claimed in claim 1 further having a birefringence of between $50 \times 10^{-3}$ and $100 \times 10^{-3}$.

3. A spun polyester yarn as claimed in claim 2 further having a birefringence of between $60 \times 10^{-3}$ and $100 \times 10^{-3}$.

4. A spun polyester yarn as claimed in claim 1 having an intrinsic viscosity of between 0.55 and 0.70.

5. A spun polyester yarn as claimed in claim 1 having an amorphous orientation greater than $15 \times 10^{-2}$.

6. A spun polyester yarn as claimed in claim 5 having an amorphous orientation greater than $20 \times 10^{-2}$.

* * * * *